US010005169B2

(12) United States Patent
Sabo

(10) Patent No.: US 10,005,169 B2
(45) Date of Patent: Jun. 26, 2018

(54) MODULAR HONING GUIDE SYSTEM

(71) Applicant: Daniel Barry Sabo, Taylor, MI (US)

(72) Inventor: Daniel Barry Sabo, Taylor, MI (US)

( * ) Notice: Subject to any disclaimer, the term of this patent is extended or adjusted under 35 U.S.C. 154(b) by 238 days.

(21) Appl. No.: 15/075,800

(22) Filed: Mar. 21, 2016

(65) Prior Publication Data

US 2016/0207160 A1 Jul. 21, 2016

Related U.S. Application Data

(63) Continuation-in-part of application No. 13/886,539, filed on May 3, 2013, now Pat. No. 9,289,874.

(51) Int. Cl.
*B24B 33/10* (2006.01)
*B24D 15/06* (2006.01)

(52) U.S. Cl.
CPC ..... *B24B 33/10* (2013.01); *B24D 15/06* (2013.01)

(58) Field of Classification Search
CPC ..... B24B 33/10; B24D 15/06
See application file for complete search history.

(56) References Cited

U.S. PATENT DOCUMENTS 28,946 A * 6/1860 Turner ..... B24D 15/08 451/321
850,084 A * 4/1907 Crocker ..... B24B 19/16 451/370
2,128,591 A * 8/1938 McGill ..... B24D 15/06 451/321
4,078,338 A * 3/1978 Baughcom ..... B24D 15/06 451/378
5,018,315 A * 5/1991 Lee ..... B24D 15/02 125/2
5,547,419 A * 8/1996 Hulnicki ..... B24B 41/066 451/320
5,944,592 A * 8/1999 Hall ..... B24B 3/36 451/162
6,151,991 A * 11/2000 Seville ..... B24D 15/06 451/444
9,289,874 B1 * 3/2016 Sabo ..... B24B 33/10
2009/0088053 A1 * 4/2009 Hummel ..... B24B 3/34 451/380
2011/0081838 A1 * 4/2011 Bagley ..... B24D 15/06 451/45
2015/0174723 A1 * 6/2015 Powell ..... B23Q 16/08 451/378

* cited by examiner

*Primary Examiner* — Marc Carlson

(57) ABSTRACT

A modular honing guide system comprised of interchangeable parts, having a multitude of configurations for manually sharpening or honing a multitude of tool types used for, but not limited to wood carving, wood working, fine art printmaking, jewelry making and metal work. A plurality of edge tool clamps mountable to a universal honing guide base system. Tools are honed on planar abrading surface(s) in conjunction with a supporting honing guide base configuration moving across a work surface which is in parallel with an abrading surface or medium. Cancellation of thickness variation of individual abrading mediums, and elimination of variability of abrading surface height differentials relative to a work surface, for a plurality of abrading mediums, is provided. A multitude of bevel, skew and cutting edge profiles are attained. Resulting is a superior solution to honing guides having limited expandability and/or lacking in abrading medium thickness variation or height differential mitigation.

21 Claims, 7 Drawing Sheets

MODULAR HONING GUIDE SYSTEM

CROSS-REFERENCE TO RELATED APPLICATIONS

This application is a Continuation In Part of pending U.S. patent application Ser. No. 13/886,539, filed on May 3, 2013, which is incorporated by reference herein.

BACKGROUND—PRIOR ART

Following is a tabulation of prior art references not previously cited for the pending parent application Ser. No. 13/886,539, and appear to be relevant to this Continuation In Part Application:

US Patents

| Patent Number | Issue Date | Patentee |
|---|---|---|
| X7,010 | Apr. 19, 1832 | Madeira |
| 19,641 | Mar. 16, 1858 | Jennings |
| 28,946 | Jun. 26, 1860 | Turner |
| 102,218 | Apr. 26, 1870 | Brown |
| 189,089 | Apr. 3, 1877 | Dudley |
| 269,409 | Dec. 19, 1882 | Gowell |
| 337,559 | Mar. 9, 1886 | Cole et al. |
| 472,685 | Apr. 12, 1892 | Strong |
| 478,608 | Jul. 12, 1892 | Keist |
| 496,741 | May 2, 189 | Lamb |
| 973,968 | Oct. 25, 1910 | Pike |
| 1,294,616 | Feb. 18, 1919 | Carlson |
| 1,821,518 | Jun. 30, 1928 | Jeschke |
| 1,998,259 | Apr. 16, 1935 | Sorensen |
| 2,191,719 | Feb. 27, 1940 | Kuhlman |
| 2,558,325 | Jun. 26, 195 | Teague et al. |
| 3,721,049 | Mar. 20, 1973 | Nakahara |
| D287,095 | Dec. 9, 1986 | Hunter |
| 4,903,438 | Feb. 27, 1990 | Smith |
| 5,018,315 | May 28, 1991 | Lee et al. |
| 5,558,572 | Sep. 24, 1996 | Fletcher |

Following is a tabulation of prior art references cited by the applicant for and during pendency of parent application Ser. No. 13/886,539:

| Patent Number | Issue Date | Patentee |
|---|---|---|
| 103,739 | May 31, 1870 | Hanks |
| 223,315 | Jan. 6, 1880 | Brower |
| 449,673 | Apr. 7, 1891 | Francis |
| 471,679 | Mar. 29, 1892 | Spruce |
| 560,111 | May 12, 1896 | Salot |
| 828,853 | Aug. 14, 1906 | Ives |
| 850,084 | Apr. 9, 1907 | Crocker |
| 870,365 | Nov. 5, 1907 | Hight |
| 1,192,416 | Jul. 25, 1916 | Graves |
| 1,221,556 | Apr. 3, 1917 | McEachron |
| 1,239,494 | Sep. 11, 1917 | Lange |
| 1,770,538 | Jul. 15,1930 | Washer |
| 2,107,921 | Feb. 8, 1938 | Weed |
| 2,131,626 | Sep. 27, 1938 | Keith |
| 2,165,929 | Jul. 11, 1939 | Lentz |
| 2,370,908 | Mar. 6, 1945 | Llorens |
| 2,741,077 | Apr. 10, 1956 | Ayer |
| 3,950,899 | Apr. 20, 1976 | Gilbert |
| 5,547,419 | Aug. 20, 1996 | Hulnicki |
| 4,733,501 | Mar. 29, 1988 | McLean |
| 5,582,542 | Dec. 10, 1996 | Stein |
| 5,810,649 | Sep. 22, 1998 | Oar et al. |
| 6,393,712 | May 28, 2002 | Jansson |
| 6,935,937 | Aug. 30, 2005 | Port |

-continued

| Patent Number | Issue Date | Patentee |
|---|---|---|
| 7,144,310 | Dec. 5, 2006 | Longbrake |
| 7,335,093 | Feb. 26, 2008 | Harrelson |
| 7,553,216 | Jun. 30, 2009 | Hyde et al. |
| 8,197,304 | Jun. 12, 2012 | Hummel |
| 8,292,701 | Oct. 23, 2012 | Heng |
| 8,348,725 | Jan. 8, 2013 | Clay |
| 8,388,413 | Mar. 5, 2013 | Dovel et al. |

Wheels used as support for honing guides, were originally intended for purpose of holding honing guides and edge-tools to surfaces of large grindstones, at a consistent bevel angle. U.S. Pat. No. 28,946 (1860) Turner discloses a "spherical projection or ball" used in conjunction with an un attached honing guide which ran on rails, instead of rollers. This is the earliest reference the applicant has found for a honing guide that operates on a planar abrading surface. Turner realized that rollers for honing guides—known by various names such as tool holders—were best used on large grindstones, not on flat whetstones. His (apparent) first US patented honing guide for use on planar abrading surfaces therefore did not use wheels or rollers.

In the late 1800's, when a significant shift in tool holders occurred toward sharpening manually used edge-tools on flat abrading surfaces, many embodiments of honing guides never made the needed paradigm shift away from rollers, and toward a better solution for improved expandability and consistency in manual sharpening. Thus the ability to hone a much wider variety of edge-tool types with a complete honing guide system for planar abrading surfaces was stymied, due in part to the limiting effect that rollers create.

The 1858 Jennings patent, and US patents such as U.S. Pat. No. 103,739 Hanks (1870), U.S. Pat. No. 560,111 (1896) Salot and others, consisted of honing guides equipped with rollers for use on large $19^{th}$ century style grindstones. Wheeled honing guides for edge-tools migrated towards use on planar abrading surfaces, such as in U.S. Pat. No. 449,673 (1891) Francis, U.S. Pat. No. 870,365 (1907) Hight, U.S. Pat. No. 1,239,494 (1917) Lange, U.S. Pat. No. 3,950,899 (1976) Gilbert, U.S. Pat. No. 4,733,501 (1988) McClean and others. The prior art retained the original embodiments of rollers.

Prior art also discloses honing guides of which only a cutting edge comes into contact with an abrading surface, and a honing guide base rides on a flat smooth work surface or riser which supports both honing stone (or abrading surface) and a honing guide base. U.S. Pat. No. 223,315 (1880) Brower, U.S. Pat. No. 850,084 (1907) Crocker, U.S. Pat. No. 1,192,416 (1916) Graves, U.S. Pat. No. 1,770,538 (1930) Warner, U.S. Pat. No. 2,128,591 (1938) McGill, U.S. Pat. No. 2,741,077 (1956) Ayer, U.S. Pat. No. 5,582,542 (1996) Stein are of this type. As mentioned in the parent application, although these types of jigs offer the entire surface area of an abrading medium to a tool edge, the applicant found and disclosed in the parent application that when a plurality of honing stones or abrading mediums, each having differing thicknesses, are interchangeably used to sharpen the same tool, bevel and skew angles at a cutting edge can change due to abrading height differentials—i.e. honing stones of differing thicknesses.

The applicant has found since the filing of the parent application, that as important addressing the problem of abrading height differentials, is addressing the problem of stone or abrading medium thickness variability. For example, when a plurality of honing stones are interchangeably used during the same sharpening session for the same edge-tool, a honing stone that is thinner on one end, than on the other end, can also negatively affect bevel and skew angles due to the thickness dis-uniformity of a stone or abrading medium. This creates a situation in which the abrading surface is potentially not parallel with the plane of the work surface that a honing guide is supported by and rides upon. Such negatively effects the quality of a honed edge.

Since honing stones, whet stones or abrading mediums should be securely held in place during sharpening sessions, since the combined bevel and skew angle at the tool edge should remain constant no matter how many different abrading mediums are presented to the tool edge, what is needed, is the ability to present to a tool edge a plurality of abrading mediums at the same height, and in parallel with the plane of the supporting work surface that such honing guides ride upon. Configurations to cancel out any thickness variation within individual stones, and abrading height differentials of a plurality of stones is needed. The applicant knows of nothing in the prior art, that addresses these two important issues.

Honing edge-tools on abrasive wheels creates what is known as "hollow grind". This is the result of the beveled edge of a tool taking on the radius of the grinding wheel. The beveled edge of a tool thus takes on a concave shape, which can be undesirable, since tools sharpened or honed on a grinding wheel have generally less steel directly behind the cutting edge, due to the convex shape of the bevel. This can make the cutting edge more prone to damage or wear and can require more frequent sharpening. Securely holding a plurality of planar abrading surfaces, and canceling out both thickness variation within individual stones, and abrading height differentials of a plurality of stones, via a quick and simple way of abrading medium interchangeability, is what is needed.

Advantages

Accordingly, there are several advantages of one or more aspects as follows: to provide a honing guide system which addresses (and is not limited to) the prior art.

Provides greater access to an abrading surface, such that un even wear of an abrading surface can be mitigated since the user has access to the entire surface of the stone.

Configurations which offer simple and quick holding and canceling out of thickness variation within individual honing stones, and presenting an abrading surface to a honing guide that is always the same height from a work surface that a guide is riding on. Such provides a uniformly honed edge when abrading mediums or honing stones are interchanged.

A system that allows the user the utility of honing most or all of their tools, in a small area, on a table top or work bench, with one unified system for most or all of their tools. If the user has a collection of honing stones from coarse to fine or extra fine grades, which can be expensive, all stones can be fully utilized with a non-motorized system.

A simple method which aids in the honing of tiny short shafted gouges uniformly while providing full access of an abrading surface to the tool edge.

A system capable of honing a fingernail profile on a non-motorized planar abrading surface. The profiles can offer a multitude of benefits to those engaged in relief wood carving work and other forms of hand carving.

The possibility of "hollow grind", which is caused by the curvature of a grinding wheel on a tool edge is mitigated, since the ensuing is designed to hone tools on a planar abrading surface.

Other advantages of one or more aspects will become apparent from a consideration of the ensuing description and accompanying drawings.

SUMMARY

Abrading Height differential issues were found and addressed in the parent application. What is needed is a system to mitigate both abrading height differential and thickness dis uniformity of planar abrading surfaces, as well as a quick and easy way for the user to interchangeably hold a plurality of abrading mediums during the same sharpening or honing session, by canceling out abrading height differential and thickness dis uniformity situations for abrading mediums.

This application will disclose configurations of alternative embodiments of the elongated riser support base member system shown in the section for drawing FIG. 4, and of the height adjustable base shown in the section for drawing FIG. 10.

DRAWINGS—FIGS

In the drawings, closely related Figs. have the same number but different alphabetic suffixes. For continuity and clarity in this Continuation In Part Application, drawing reference numbers will begin at 505. Additionally, drawing figures in this Continuation In Part Application will begin at FIG. 21A.

FIGS. 21A THROUGH 21O: DETAILED STATIC DESCRIPTION

Figure 21A:
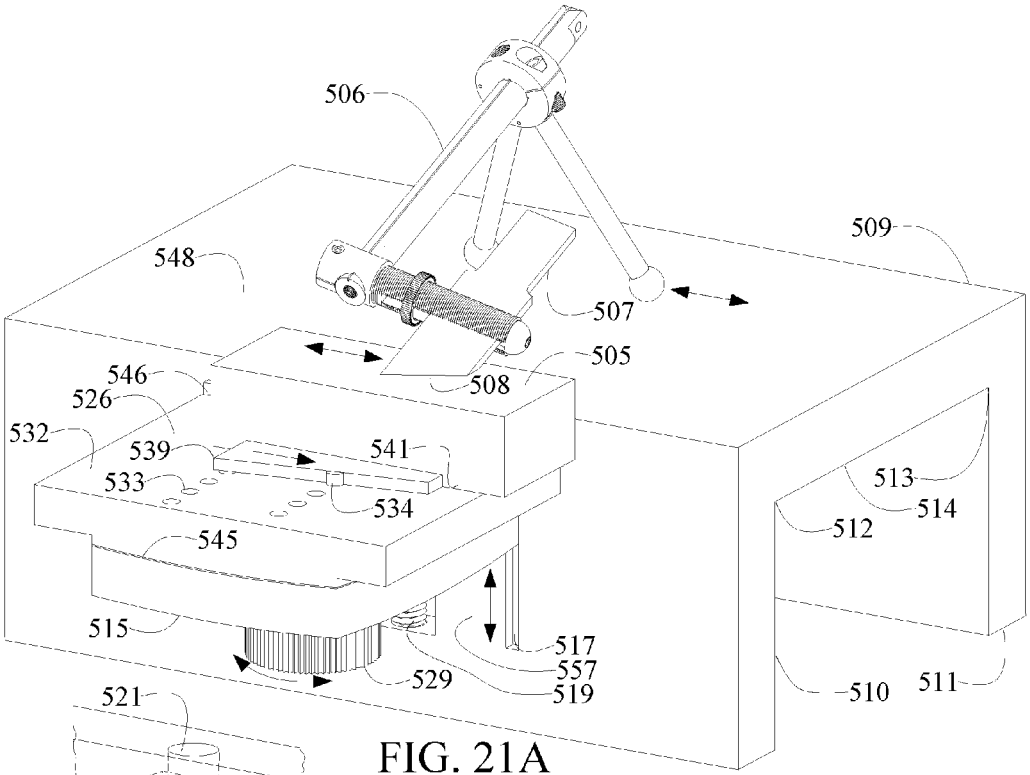
FIGS. 21A to 21O shows a spherical abrading medium holding system in use with a honing guide and honing stone, and associated components, with integral work surface included.

FIG. 21A shows a honing stone 505 (FIG. 21A) mounted to an abrading medium work platform clamping system—or an abrading medium lift configuration 509 (FIGS. 21A, 21C, 21H, 21I), in use with the Flat Tool Guide Body configuration 506 (FIG. 21A) which is holding an edge-tool 507 (FIG. 21A), and honing a tool edge 508 (FIG. 21A) on the honing stone. The base of the configuration 509, which is also an integral work surface for a honing guide, can be constructed of wood, polymer, steel, aluminum or other metallic material. The base can be a one piece fabrication as shown. Or it could be constructed as a 3-piece unit, with base supports 510 and 511 (FIGS. 21A, 21C, 21H, 21I) being separate components and bolted or otherwise affixed or attached to joint locations at or near joint locations 512 and 513 (FIG. 21A). Base support 511 could also be eliminated, if the user would prefer to place the underside 514 (FIG. 21A) of the configuration directly on a support surface or work bench, and hang base support 510 off the edge of a table, work bench or other working surface.

Figure 21B:
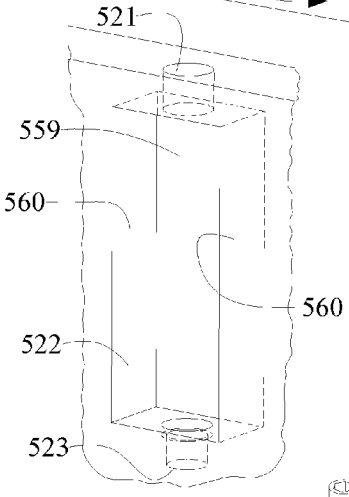
Figure 21C:
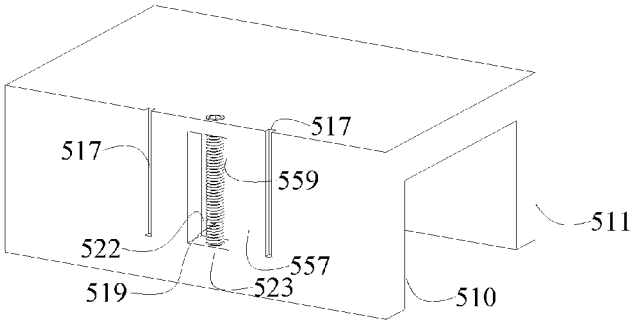
Figure 21D:
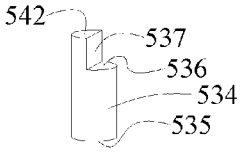
Figure 21E:
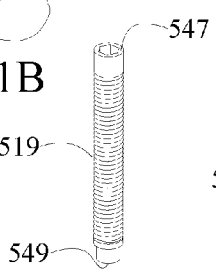
Figure 21F:
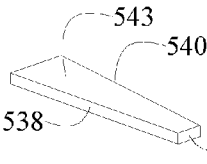

Note that base supports 510 and 511 are not identical. To base support 510 is mounted a spherical lift plate 515 (FIG. 21A, 21H, 21I, 21J, 21K, 21L, 21N). Spherical lift plate 515 has lift plate tangs 516 (FIGS. 21J, 21K, 21L, 21N) which fit into slots or ways 517 (FIGS. 21A, 21C). Spherical lift plate 515 also has a wide threaded tang 518 (FIGS. 21J, 21K, 21L, 21N), into which a threaded rod or screw 519 (FIGS. 21A, 21C, 21E, 21H, 21I), is threaded into a threaded bore 520 (FIGS. 21J, 21K, 21L), after the rod is inserted into a through bore hole 521 (FIG. 21B) and after the wide threaded tang 518 is inserted into a wide slot or way 522 (FIGS. 21B, 21C). Once threaded, the threaded rod end 549 (FIG. 21E) seats into blind bore hole 523 (FIGS. 21B, 21C). A top surface 547 (FIG. 21E) of threaded rod 519 is flush or nearly so with a top surface of 548 (FIG. 21A) of the abrading medium lift configuration 509.

Figure 21G:
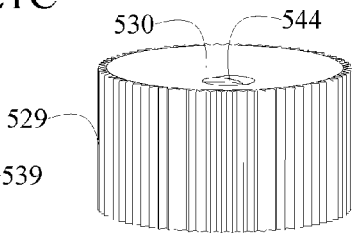
Figure 21H:
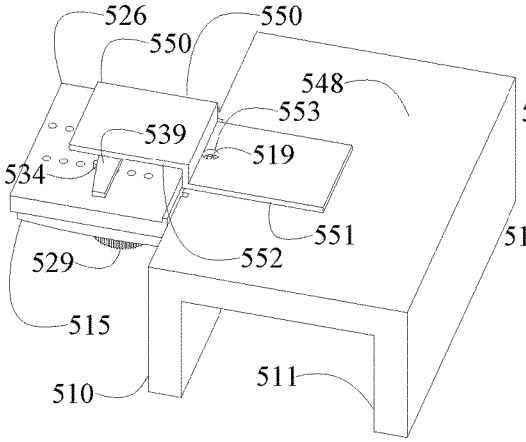
Figure 21I:
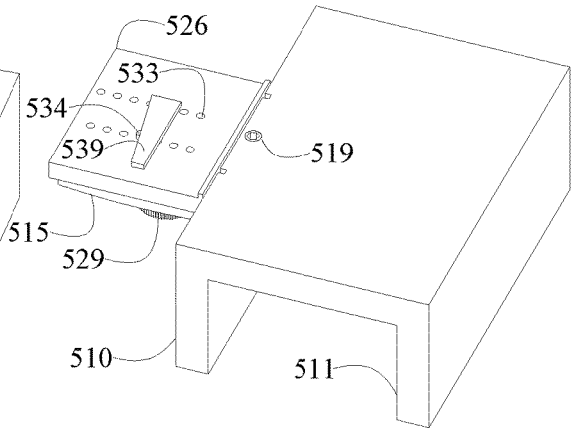
Figure 21J:
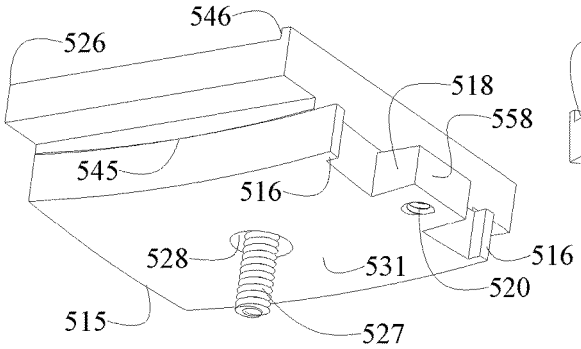
Figure 21K:
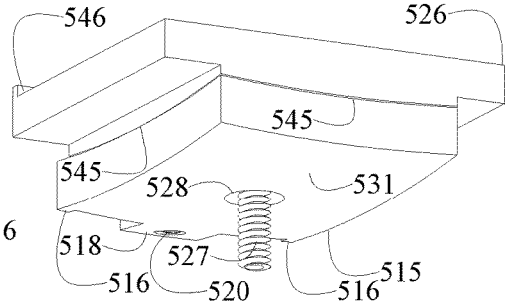
Figure 21L:
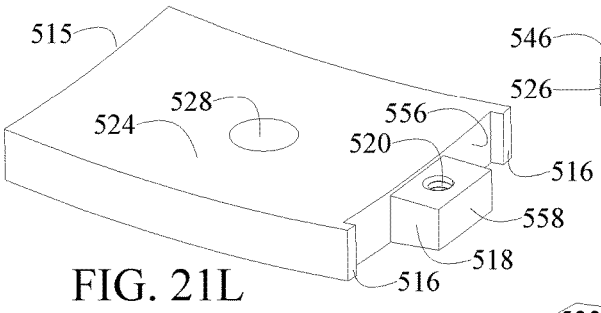
Figure 21M:
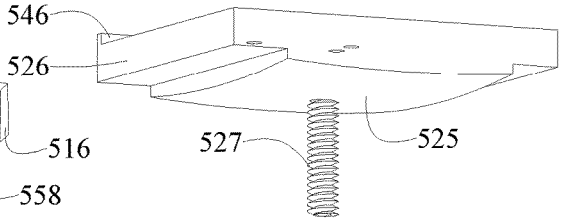

An uppermost surface of spherical lift plate 515, is a concave spherical or dished surface 524 (FIG. 21L), into which seats a convex spherical surface 525 (FIG. 21M), of an abrading medium mount plate 526 (FIGS. 21A, 21H, 21I, 21J, 21K, 21M, 21N). The joint of the dish surface 524, and the convex surface 525, is shown at a spherical surface joint 545 (FIGS. 21A, 21J, 21K). An OD threaded stud 527 (FIGS. 21J, 21K, 21M, 21N) which is either permanently affixed to, or threaded into and towards the center (normal to) the convex spherical surface 525, inserts through an oversized through bore 528 (FIGS. 21J, 21K, 21L).

A threaded knob or thumbwheel 529 (FIGS. 21A, 21G, 21H, 21I), has a surface that is spherically dished 530 (FIG. 21G), which comes into contact with a bottommost convex spherical surface 531 (FIGS. 21J, 21K) of the spherical lift plate 515 as it is tightened onto threaded stud 527 through threaded bore 544 (FIG. 21G).

On a top surface 532 (FIG. 21A) of abrading medium mount plate 526 are blind holes 533 (FIGS. 21A, 21I, 21N), into which a miniaturized bench dog 534 (FIGS. 21A, 21D, 21H, 21I) can be inserted into any blind bore hole 533. A bottom surface 535 (FIG. 21D) of dog 534 seats to the bottom of blind holes 533, such that a dog surface 536 (FIG. 21D) is flush or nearly so with the top surface 532. Dog 536 can then freely rotate in blind holes 533. A vertical flat surface 537 (FIG. 21D) of dog 534 comes into contact with a side surface 538 (FIG. 21F) of a wedge shaped clamp jaw 539 (FIG. 21A, 21F, 21H, 21I). An opposite side of the wedge clamp jaw 540 (FIG. 21F) comes into contact with a bottom edge 541 (FIG. 21A) of the honing stone 505, as it is forced between dog surface 537 and bottom edge 541, and forces the opposite edge of the honing stone 505, against a fence 546 (FIGS. 21A, 21J, 21K, 21M, 21N). A top surface 542 of dog 534 (FIG. 21D) is flush or nearly so with a top surface 543 (FIG. 21F) of wedge 539. A fence side end 554 (FIG. 21N) of abrading medium mount plate 526 is offset 555 (FIG. 21N) from a fence side end 556 (FIG. 21L, 21N) of spherical lift plate 515. Fence side end 556 comes into contact with a fence side 557 (FIGS. 21A, 21C) of abrading medium lift configuration 509. Wide threaded tang 518 has an end 558 (FIGS. 21J, 21L, 21N) which comes into contact with a fence side slot wall 559 (FIGS. 21B, 21C).

An abrading medium leveling plate 550 (FIGS. 21H, 21O) has an underside 551 (FIGS. 21H, 21O), which is supported by and sits freely on the top surface 548, and can be freely moved on, or removed from top surface 548 at any time. Abrading medium leveling plate 550 has a second underside 552 (FIGS. 21H, 21O) which comes into contact with the abrading medium. Abrading medium leveling plate 550 has a through bore 553 (FIGS. 21H, 21O) which allows access to screw 519, if placed at center of abrading medium lift config 509 along lift edge.

Figure 21O:
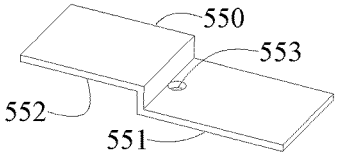
Figure 21N:
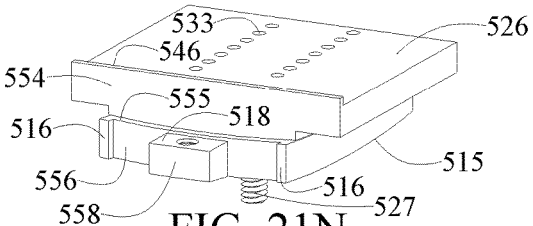

FIGS. 21A Through 21O; Detailed Operational Description

The abrading medium lift configuration 509 allows the user to hold multiple sizes of several different honing, whetstones or abrading mediums to the abrading medium mount plate 526, and cancels out any thickness variations within individual stones, and or thickness variations across a range or set of honing stones. Any height differentials between two or more stones that are interchanged during a honing or sharpening session of an edge-tool are also cancelled out. Such allows the user to set bevel and skew angles of any honing guide only one time, without worry of an abrading surface being out of parallel with a work surface, or at a different relative height compared to a previously used honing stone.

This is accomplished by placing a honing stone 505 on abrading medium mount plate 526, and inserting a dog 534 into a blind hole 533 that is close enough to the stone to slide wedge shaped clamp jaw 539 between stone and dog, but not so far that clamping power is not possible. Once the jaw is slid into place, the edge 540 abuts against the side of the honing stone 505. A tap on the end of clamp jaw 539 with a dense block of wood or similar material will press the jaw tightly in place. An advantage of using a dog that is freely rotatable in a blind hole, is that the wedge can follow the edge of the honing stone. This is beneficial if the honing stone is not perfectly square. As a result, the edge of wedge shaped clamp jaw 539 is in full contact with the honing stone, providing maximum clamping power. To unclamp the stone, a tap on the opposite side of the wedge quickly unclamps the honing stone.

Once the honing stone is clamped securely into place, abrading medium leveling plate 550 is placed on top surface 548, and the underside 552 placed above the honing stone. Knob 529 is then loosened, and the socket at the top surface 547 of screw 519 is rotated with a wrench to slowly dial up the spherical lift plate 515 to meet the underside 552 with the surface of the abrading medium. Since knob 529 is loosened, abrading medium mount plate 526 is able to tilt in the spherical socket. As the abrading surface presses up against the leveling plate, the abrading surface seats itself against underside 552. Once the abrading surface seats against underside 552, knob 529 is tightened, thus clamping abrading medium mount plate 526 tightly into place. Since the surface area of the spherical socket is relatively large, good clamping power is provided. During this process, one hand is used to hold the leveling plate onto the top surface 548, while the other hand turns screw 519. The abrading surface is now parallel to the work surface. The leveling plate can be removed from the surface, and honing can then begin. Since only one leveling plate is used, no matter what the thickness of the stone, and no matter the stone thickness dis-uniformity, every stone used has a surface that is presented parallel to and at the same relative distance from the work surface.

The tangs 516 and 518 provide good stability to lift plate 515 and prevents it from going out of parallel relative to the top surface 548.

Figure 22A:
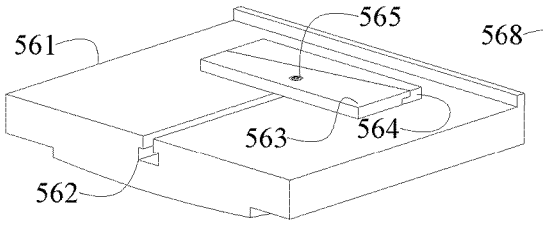
FIGS. 22A to 22N show some alternate embodiments of portions of the spherical abrading medium holding configuration, some of which could also be used in the non-spherical abrading medium holding configurations of drawing FIG. 23.
Figure 22B:
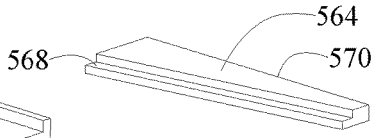
Figure 22C:
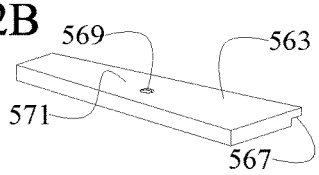
Figure 22D:
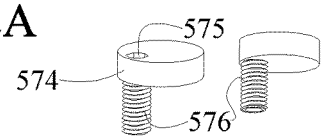
Figure 22E:
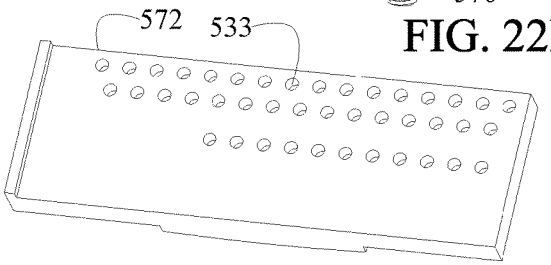
Figure 22F:
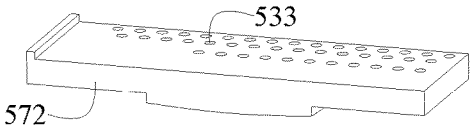
Figure 22J:
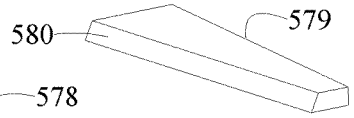
Figure 22G:
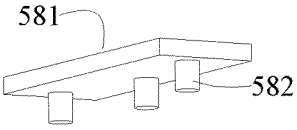
Figure 22H:
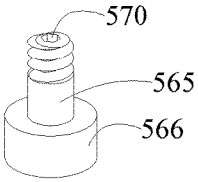
Figure 22I:
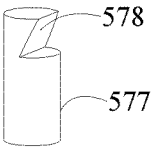
Figure 22K:
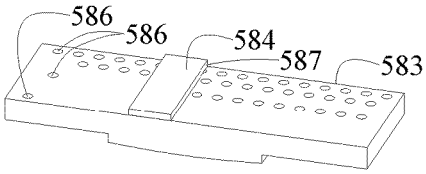
Figure 22L:
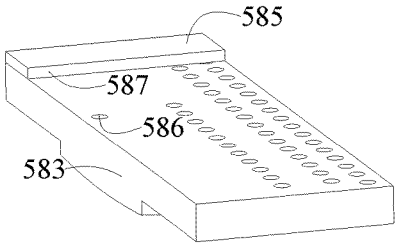
Figure 22M:
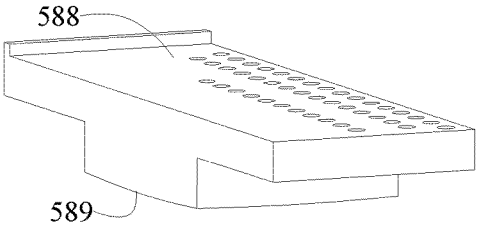
Figure 22N:
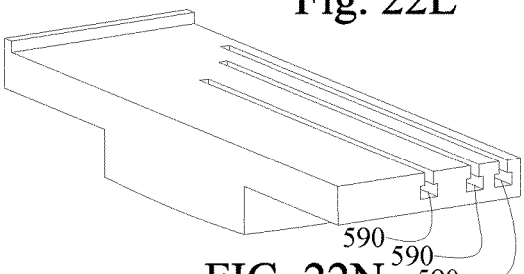

FIGS. 22A Through 22N: Detailed Static Description

FIG. 22A shows an alternate embodiment of the abrading medium mount plate 526, which is a slotted abrading medium mount plate 561. The difference between the two being that in lieu of the blind holes 533, dog 534 and the wedge shaped clamp jaw 539, is a slot 562 (FIG. 22A), combined with a wedge clamp jaw 563 (FIGS. 22A, 22C), a wedge 564 (FIGS. 22A, 22B), and a bolt 565 (FIGS. 22A, 22H) having a circular disc-end 566 (FIG. 22H). Slot 562 can have any shape, such as a T shape as shown, as well as a dovetail shape, or other shapes. Wedge clamp jaw 563 and wedge 564 are shown with a clamp step 567 (FIG. 22C) and a wedge step 568 (FIG. 22B). However, both wedge clamp jaw 563 and wedge 564 could be made without clamp and wedge steps, both having flat sides which come into contact at the location of both shown steps of FIG. 22A. Wedge clamp jaw 563 has a threaded bore 569 (FIG. 22C), into which bolt 565 threads. An edge 570 (FIG. 22B) of wedge 564 abuts against a bottom edge of a honing stone or abrading medium. A bolt top 570 (FIG. 22H), of bolt 565, is flush or nearly so, to a top surface 571 (FIG. 22C) of wedge clamp jaw 563, when fully tightened into place.

An alternate embodiment of the slotted abrading medium mount plate 561, called an extended abrading medium mount plate 572 (FIGS. 22E, 22F), is shown. The difference being the blind bore holes 533 run lengthwise along a relatively longer abrading medium mount plate.

A socketed 575 eccentric cam topped bolt 574 (FIG. 22D) is shown, which can be an alternate embodiment to dog 534 and wedge shaped clamp jaw 539. Although a post 576 (FIG. 22D) is shown as threaded, it can also be unthreaded as in dog 534. If unthreaded, it can be inserted into the blind bore holes 533. If threaded, it can be threaded into any threaded blind bore hole 533. Note that Blind bore holes 533 can either be threaded, or unthreaded.

Shown is an alternate embodiment of dog 534, an angled faced dog 577 (FIG. 22I), which has an angled dog face 578 (FIG. 22I). The angled faced dog 577 is matched to an alternate embodiment of wedge shaped clamp jaw 539, an angled faced wedge shaped clamp jaw 579 (FIG. 22J), which has an angled jaw face 580 (FIG. 22J).

An alternate embodiment of fence 546 is shown; a re positionable fence 581 (FIG. 22G). A post on re positionable fence 581 is shown; a fence post 582 (FIG. 22G). Re positionable fence 581 can have any number of fence post(s) 582. Re positionable fence 581 is matched to an alternate embodiment of abrading medium mount plate 526, a re positionable fence abrading medium mount plate 583 (FIGS. 22K, 22L). FIG. 22K shows a position 584 of re positionable fence 581, and FIG. 22L shows a second position 585, on the re positionable fence 581. The re positionable fence abrading medium mount plate 583 shows additional blind bore holes 586 (FIG. 22K) to accommodate re positionable fence 581, of which there can be any number of blind bore holes 533 or 586 for any configuration shown. A side of the fence which contacts an edge of an abrading medium or whetstone, is shown as 587 (FIG. 22K, 22L).

In FIG. 22M is shown an alternate embodiment of abrading medium mount plate 526, namely, an abrading medium mount plate extended sphere version 588. The abrading medium mount plate extended sphere version 588 has the convex spherical surface 525 extended relatively further away or downward from the top surface 532, as shown in an extended spherical surface 589 (FIG. 22M). In FIG. 22N is shown alternate embodiment of an abrading medium mount plate extended sphere version 588, namely, which is a slotted version 590 (FIG. 22N). Note that shown elements of abrading medium mount plate 526 and alternate embodied abrading medium mount plates and related elements can be used or combined or interchanged in a multitude of other alternate embodiments not shown.

FIGS. 22A Through 22N; Detailed Operational Description

Wedge clamp jaw 563, wedge 564 and bolt 565 are slid along the slot 562 to meet the edge of a honing stone or abrading medium. Once wedge 564 comes into full contact with the edge of a honing stone, bolt 565 is tightened to the slot and wedge clamp jaw 563, and the end of wedge 564 is tapped on end to force the edge of the wedge against the base edge of the honing stone, thus pressing the opposite edge of the stone onto the fence (shown as 546 in the previous embodiment). Using wedges allows the user to very quickly change out honing stones. These two wedges are shown as stepped as in steps 567 and 568, but stepped wedges are not required. They do however provide some extra stability to the clamping process.

The alternate embodiment to using wedges as a clamp, the eccentric cam topped bolt 574, can be used in lieu of the dog 534 and in combination with either threaded or unthreaded blind holes 533. Instead of using a wedge, a blind hole is chosen closest to the edge of a honing stone, and a cam inserted or threaded into or rotated into a blind hole with a wrench, such that the edge of a cam (shown in 574) applies clamping pressure to the edge of a honing stone or abrading medium, forcing it against fence 546.

The alternate embodied extended abrading medium mount plate 572, is used in the same way that mount plate 526 is. This just shows another variation of a mount plate configuration. The re positionable fence abrading medium mount plate 583 is an alternative to the fixed fence 546. The extended spherical surface 589 is an alternative embodiment of the abrading medium mount plate 526. An extended spherical surface provides more tilting ability of the mount plate, since it projects the honing surface relatively further away from the concave spherical or dished surface 524 than mount plate 526 does. The slots 590 shown in FIG. 22N show a variation of the extended abrading medium mount plate 572. Slots 590, wedge clamp jaw 563, wedge 564 and bolt 565 are used as earlier described, in place of blind holes/wedge combinations. In the extended versions of mount plates, three rows of either blind holes or slots are shown, to provide the user the convenience of clamping very narrow honing stones. Any mount plate however can have any number and configuration of blind threaded or unthreaded holes.

FIGS. 23A Through 23J: Detailed Static Description

Figure 23A:
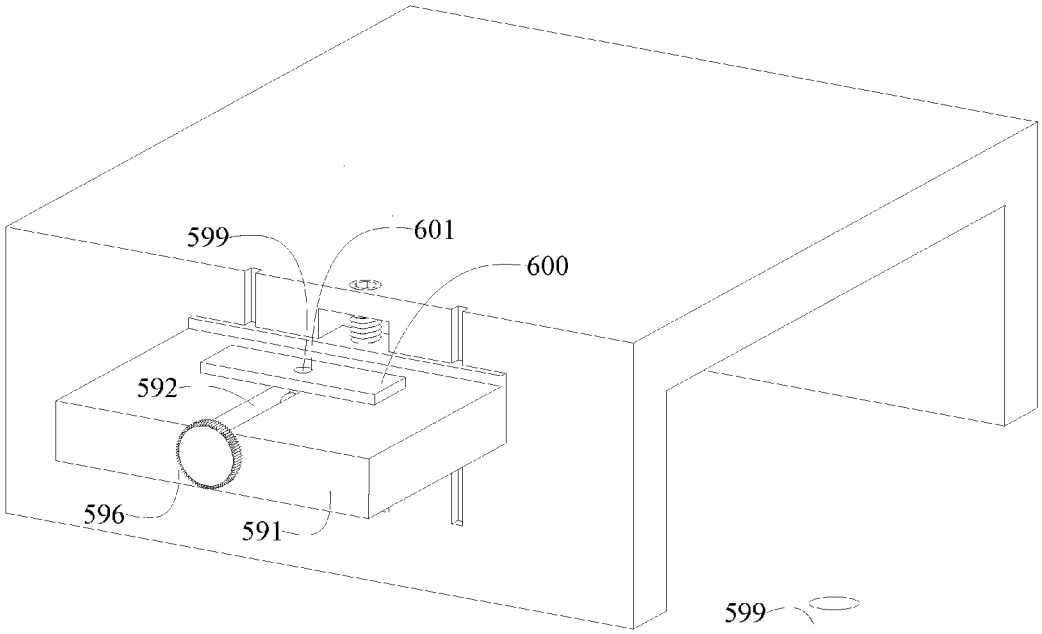
FIGS. 23A to 23J shows a non-spherical abrading medium holding configuration and associated components, with integral work surface included.
Figure 23B:
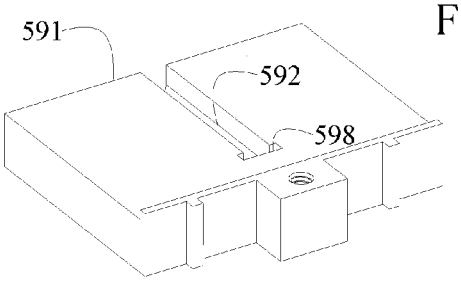
Figure 23C:
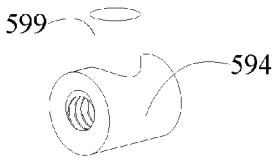
Figure 23D:
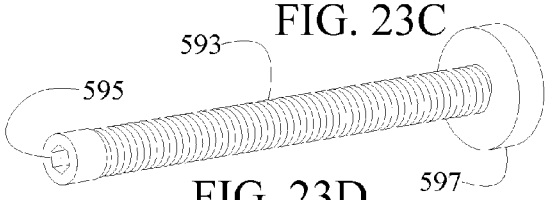
Figure 23E:
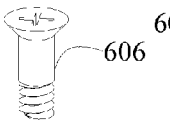
Figure 23F:
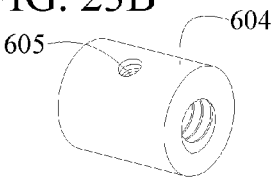
Figure 23G:
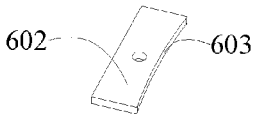
Figure 23H:
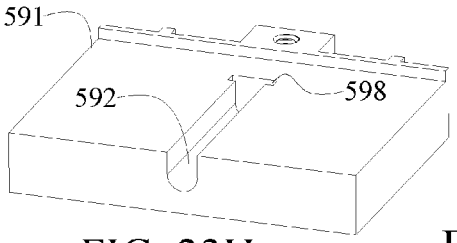
Figure 23I:
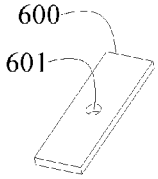
Figure 23J:
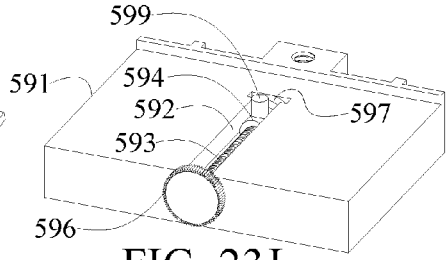

An alternate embodiment of the combined spherical lift plate 515 and abrading medium mount plate 526 is shown; a non-spherical lift plate 591 (FIGS. 21A, 23B, 23H, 23J). Lift plate 591 shows a slot 592 (FIGS. 23A, 23B, 23H, 23J), into which a threaded clamp rod 593 (FIGS. 23D, 23J) is inserted, after which a threaded clamp jaw pin-collar 594 (FIG. 23C, 23J) is threaded onto threaded clamp rod 593. Threaded clamp rod 593 can have either a hex or other type of socket 595 (FIG. 23D), or a thumbwheel 596 (FIGS. 23A, 23J). If thumbwheel, the combined threaded clamp rod 593, clamp jaw pin-collar 594, and thumbwheel 596 can be an assembly, with thumbwheel 596 either welded, brazed or otherwise adhesively attached or pinned to the end of threaded clamp rod 593, or held onto threaded clamp rod 593 with a setscrew (not shown). Or freely removable by way of a hex or other type of socket in the thumbwheel, and a hex or other type of end on threaded clamp rod 593. The opposite end of threaded clamp rod 593 shows a clamp rod clamp disc 597 (FIGS. 23D, 23J) which is either permanently affixed to the end of threaded clamp rod by welding, brazing or otherwise adhesively affixed, or by being machined in to the rod as a one-piece unit.

Clamp rod clamp disc 597 is inserted into a T-ended slot 598 (FIGS. 23B, 23H), while threaded clamp rod 593 and clamp jaw pin-collar 594 is inserted into slot 592. Slot 592 has a width which is the same as or slightly greater than the outside diameter of clamp jaw pin-collar 594.

A clamp jaw pin 599 (FIGS. 23A, 23C, 23J) is shown; onto clamp jaw pin 599 is inserted a clamp jaw 600 (FIGS. 23A, 23I), through a clamp jaw bore 601 (FIGS. 23A, 23I). An alternate embodiment of clamp jaw 600, is curved clamp jaw 602 (FIG. 23G), which has a curved clamping face 603 (FIG. 23G), for purpose of clamping round honing stones. An alternate embodiment of clamp jaw pin-collar 594, is a threaded clamping collar 604 (FIG. 23F), which has a threaded pin collar bore 605 (FIG. 23F), into which a threaded pin 606 (FIG. 23E) is screwed into, after insertion through clamp jaw bore 601. Clamp jaw 600 can freely rotate about either threaded pin 606 or clamp jaw pin 599. Clamp jaw bore 601 can either be a straight bore or a countersunk bore.

FIGS. 23A Through 23J: Detailed Operational Description

Lift plate 591 is an alternative embodiment which mitigates only abrading height differentials of a plurality of stones, when this is all that is needed. Abrading medium leveling plate 550 and screw 519 are used in the same way as previously described to set the abrading medium height. The difference being there is no knob 529 to tighten. Lift plate 591 uses a vise type action to clamp honing stones. Instead of wedges or slots, a clamping jaw forces the edge of a honing stone against fence 546. This is accomplished by clamp rod clamp disc 597 pressing against the faces of the T-ended slot 598 (the faces further away from the abrading medium lift configuration 509), as the screw is turned and the Clamp jaw 600 presses an abrading medium up against fence 546, by virtue of clamp jaw pin 599 or threaded pin 606.

Note that a vise type of clamping embodiment can be used with any of the previously discussed abrading medium or honing stone mount plates in lieu of wedges or slots or the like.

FIGS. 24A Through 24K: Detailed Static Description

Figure 24A:
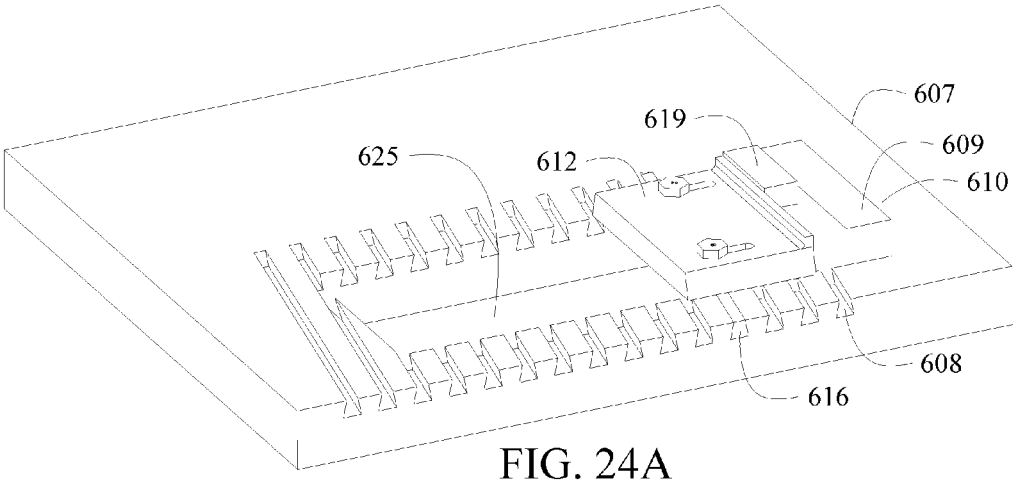
FIGS. 24A to 24K shows an abrading medium work platform clamping or holding system and associated components, with integral work surface included.
Figure 24B:
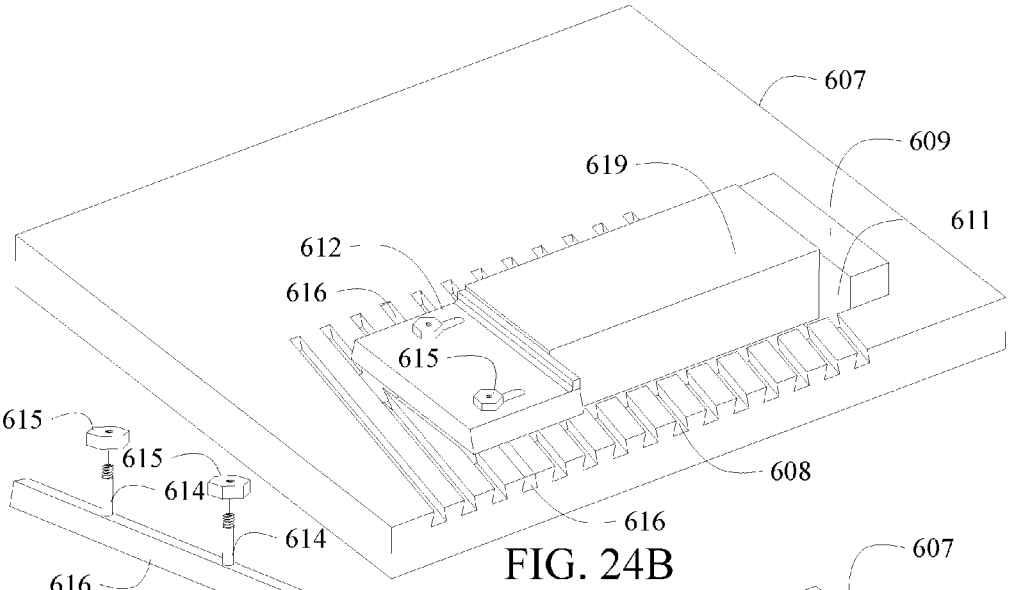
Figure 24C:
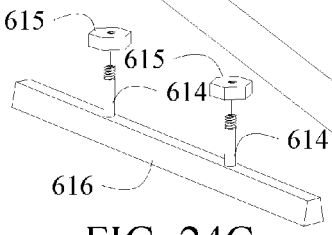

An abrading medium work platform 607 is shown (FIGS. 24A, 24B, 24E, 24F, 24G). It is comprised of a multitude of wedge slots 608 (FIGS. 24A, 24B, 24E, 24F, 24G), and an integral work surface 610 (FIGS. 24A, 24Q for a honing guide. The slots shown are dovetail slots, but they could also be T-slots, square slots, or differently shaped slots. Shown as integral to the abrading medium work platform is a stationary jaw 609 (FIGS. 24A, 24B, 24E, 24F, 24G). Stationary jaw 609 is attached to work platform 607 by either welding, brazing, adhesive or as machined in. It could also be bolted to the surface 610 (FIG. 24A) by using two sets of nuts, bolts, via two bore holes through Stationary jaw 609 and through work platform 607 on one end 610 (FIG. 24A) of work platform 607, nuts, bolts and bore holes not shown. The slots 608 are slightly angled relative to a clamping face 611 (FIG. 24B).

Figure 24D:
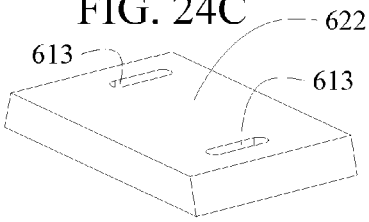
Figure 24E:
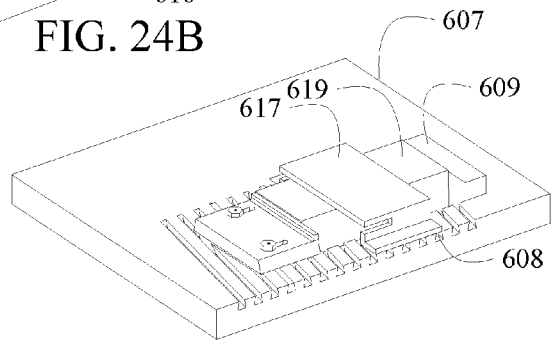
Figure 24F:
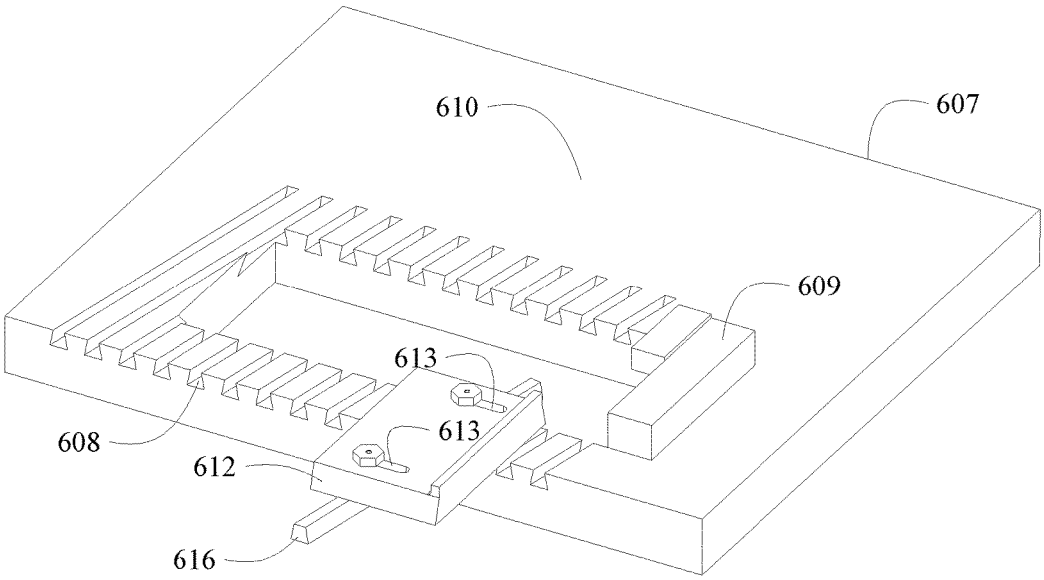
Figure 24G:
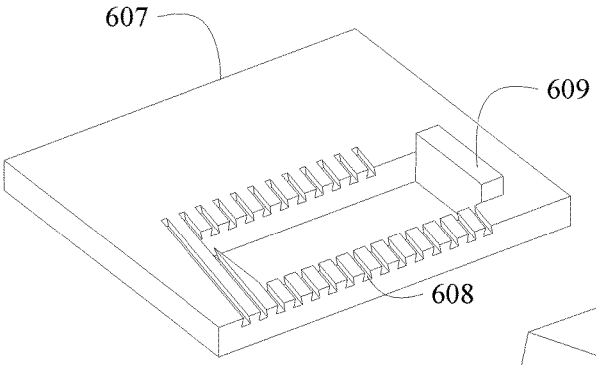
Figure 24H:
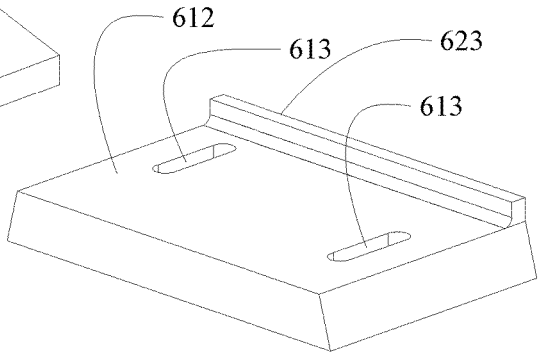
Figure 24I:
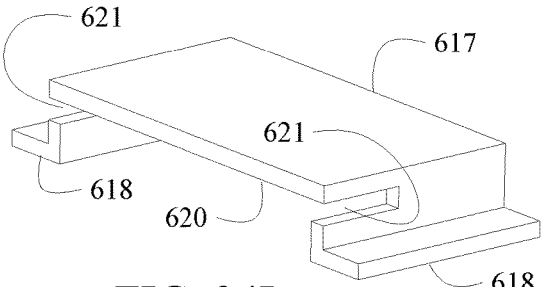

Clamp rod posts 614 (FIG. 24C) are shown. A clamp jaw 612 (FIGS. 24A, 24B, 24F) is shown having a pair of clamp jaw slots 613 (FIGS. 24D, 24F, 24H). Clamp jaw slots 613 are inserted around the two clamp rod posts 614, and a pair of two nuts 615 (FIGS. 24B, 24C) are threaded on clamp rod posts 614. Clamp jaw slots 613 are wider than the outside diameter of clamp rod posts 614. The clamp rod posts 614 are fixed to a wedge clamp slot rod 616 (FIGS. 24A, 24B, 24C, 24F). Clamp rod posts 614 are either welded, brazed or otherwise attached by adhesive or other means to clamp slot rod 616. Or, the ends of clamp rod posts 614 can be threaded and installed into a (not shown) threaded bore in clamp slot rod 616.

An Abrading medium leveling plate 617 (FIGS. 24E, 24I) is shown. Leveling plate 617 is placed on work platform 607 and is supported by base faces 618 (FIG. 24I), and straddles an abrasive medium surface 619 (24A, 24B, 24E). An underside 620 (FIG. 24I) of leveling plate 617 comes into contact with abrading medium surface 619 (FIGS. 24A, 24B). Leveling plate slots 621 (FIG. 24I) provide access for a small wrench (not shown) to nuts 615.

Figure 24J:
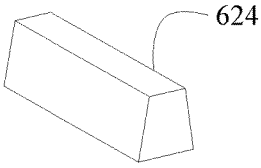
Figure 24K:
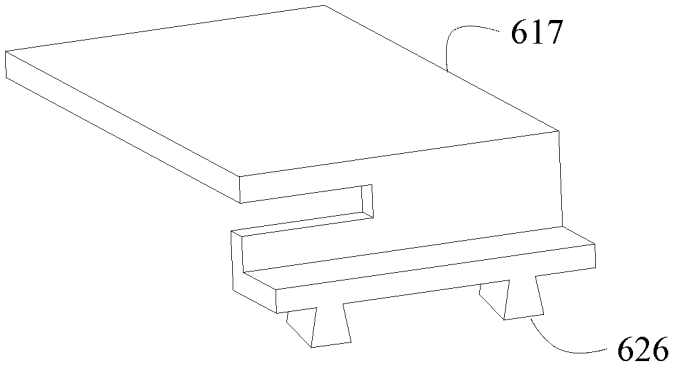

FIG. 24D shows an alternate embodiment 622 of clamp jaw 612, and does not have an elevated fence 623 (FIG. 24H) as does Clamp jaw 612. FIG. 24J shows a slot insert 624 which can be shaped in a multitude of ways to match the shape of slots 608. Opening 625 is a through hole through work platform 607 and provides access to the underside of the abrasive medium surface 619.

FIGS. 24A Through 24K: Detailed Operational Description

The abrading medium work platform 607 utilizes wedges to both clamp and cancel out thickness variations within individual stones, and abrading height differentials of a plurality of stones. In this regard it accomplishes the same function as the combination of the spherical lift plate 515 and abrading medium mount plate 526. As the underside of a honing stone or abrading medium is held by hand through the opening 625 or above, either Clamp jaw 612 or 622 and clamp slot rod 616 assembly are used, nuts 615 are loosened, and clamp slot rod 616 is slid into a slot 608 that allows the clamp jaw to be brought into contact with the edge of an abrading medium. Nuts are then tightened and clamp jaw snugged up against honing stone before clamping. While clamp slot rod 616 still protrudes out of a slot 608, leveling plate 617 base faces 618 are placed over slots 608 positioning it over an abrading medium surface, and the stone or abrading medium surface is gently pressed against the underside 620 of leveling plate 617. The jaw is then pressed forward in wedge like fashion to clamp a honing stone or abrading medium into place.

Since the underside of leveling plate 617 is parallel with the surface 610 of platform 607, the abrading medium surface is also parallel to the surface of the platform. The platform surface is then used as a base for any honing guide. Leveling plate 617 can be held by hand onto the surface of work platform 607 during the clamping procedure. Or, leveling plate 617 can be provided with a slot key 626 as shown in FIG. 24, installing it into key slots prior to clamping, thus holding it flush to the surface of work platform 607 during the clamping operation.

The advantage of having clamp slots 613 for rod posts 614, is so that for honing stones that are not square, the clamp jaw cam come into complete contact with the abrading medium edge and provide good clamping power. The slot insert 624 may provide additional strength to the keyway slots when clamping, if inserted into the first adjacent slot behind the clamp law.

Alternate Embodiments not Shown in Drawings in this Continuation in Part

Note that any of the previously disclosed honing guide configurations in the parent application which can use the elongated riser support members, can as an alternate embodiment use any of the herein disclosed. The advantage being that securely holding one or a plurality of planar abrading surfaces, while canceling out both thickness variation within individual stones and across a range of stones, and abrading height differentials across a series of abrading surfaces, is the result. Such is what is needed for any honing guide that is not supported by an abrading surface.

Additionally, in lieu of the height adjustable base in the parent application shown in drawings of section 10 for the fingernail profile configurations, any of the disclosed herein could be used as an alternative embodiment. Instead of using the height adjustable base for the fingernail profile arm shown in drawings 10 in the parent application, the ball 219 shown in FIG. 10M and in other drawings in the parent application, could come into direct contact with, and rock directly on the work surface with the fingernail arm configuration.

Additionally, a plurality of interchangeable ball sizes for ball 219 shown in the parent application could be used for variation in fingernail profiles.

CONCLUSION, RAMIFICATIONS AND SCOPE

Although the description above contains many specificities, these should not be construed as limiting the scope of the embodiments but as merely providing illustrations of some of several embodiments. Thus the scope of the embodiments should be determined by the appended claims and their legal equivalents, rather than by the examples given.

I claim:

1. An abrading medium lift system configured to secure an abrading medium comprising, an abrading surface, a first side surface, and a second side surface, relative to a topmost working surface to remove the effect of height variation and thickness variation, the system comprising:

a base comprising the topmost working surface;

an abrading medium mounting plate comprising a top surface, the abrading medium mounting plate configured with a clamping arrangement to secure the abrading medium on the top surface, the abrading medium mounting plate additionally comprising a stopping surface configured to abut the first side surface of the abrading medium when secured on the abrading medium mounting plate;

a coupling arrangement comprising a sliding connection between the abrading medium mounting plate and the base configured to allow the abrading medium mounting plate to move vertically relative to the base, the sliding connection additionally configured to maintain the top surface parallel to the topmost working surface;

a lifting mechanism comprising a threaded rod configured to rotate about a threaded axis, wherein the rotation of the threaded rod controls a vertical distance between the top surface and the topmost working surface;

wherein in operation, the base is stationary, the abrading medium is secured to the top surface with the clamping arrangement, and the abrading medium mounting plate is vertically positioned by rotation of the threaded rod to locate the abrading surface at a desired distance from the topmost working surface.

2. The abrading medium lift system of claim 1, further comprising:

a leveling plate with a surface configured to rest on the topmost working surface and a positioning surface configured to contact the abrading surface when the desired distance has been established.

3. The abrading medium lift system of claim 1, wherein the abrading medium comprises at least one of a grinding stone, honing stone, whetstone or other abrading material.

4. The abrading medium lift system of claim 1, wherein the clamping arrangement comprises:

a plurality of blind holes in the top surface of the abrading medium mounting plate;

at least one removable pin, configured to be inserted into at least one of the plurality of blind holes;

a wedge shaped clamp jaw, configured to slide on the top surface, the wedge shaped clamp jaw comprising a first edge surface configured to slidingly abut the at least one removable pin and a second edge surface configured to slidingly abut the second side surface of the abrading medium;

wherein the wedge shaped clamp jaw is configured to be placed on the top surface and simultaneously abut the at least one removable pin and the second side surface of the abrading medium and be additionally slid to create a wedging force between the at least one removable pin and the second side surface of the abrading medium that clamps the abrasive medium against the stopping surface of the abrading medium mounting plate.

5. The abrading medium lift system of claim 1, wherein the clamping arrangement comprises:

at least one slot in the abrading medium mounting plate the at least one slot forming at least one extending bottommost slot surface parallel to the top surface;

a clamp jaw comprising a second edge surface, configured to abut the second side surface of the abrading medium, and configured to slide in the at least one slot and slide on the top surface;

a threaded clamp rod, attached to the clamp jaw and configured to rotate about a screw axis and thereby position the clamp jaw on the top surface;

wherein the threaded clamp rod is rotated to position the second edge surface to abut the second side surface of the abrasive medium and is additionally rotated to create a force between the clamp jaw and the second side surface of the abrading medium that clamps the abrasive medium against the stopping surface of the abrading medium mounting plate.

6. The abrading medium lift system of claim 1, wherein the clamping arrangement comprises:

at least one slot in the abrading medium mounting plate the at least one slot forming at least one extending bottommost slot surface parallel to the top surface;

a wedge clamp jaw, configured to secure on the top surface, the wedge clamp jaw comprising a first wedge surface;

a wedge plate comprising a second wedge surface and a second edge surface, the wedge plate configured to be placed on the top surface with the second wedge surface in abutment with the first wedge surface, and the second edge surface in abutment with the second side surface of the abrading medium;

wherein the wedge plate is configured to be placed on the top surface and simultaneously abut the first wedge surface of the wedge clamp jaw and the second side surface of the abrading medium and be additionally slid to create a wedging force between the wedge clamp jaw and the second side surface of the abrading medium that clamps the abrasive medium against the stopping surface of the abrading medium mounting plate.

7. An abrading medium lift system configured to secure an abrading medium comprising, an abrading surface, a first side surface, and a second side surface, relative to a topmost working surface to remove the effect of height variation, thickness variation and parallelism variation, the system comprising:

a base comprising the topmost working surface;

an abrading medium mounting plate comprising a bottom surface and a top surface, the abrading medium mounting plate configured with a clamping arrangement to secure the abrading medium on the top surface, the abrading medium mounting plate additionally comprising a stopping surface configured to abut the first side surface of the abrading medium when secured on the abrading medium mounting plate;

a lift plate comprising a mounting surface, the lift plate configured with an adjustment arrangement to adjust and secure the bottom surface of the abrading medium mounting plate on top of the mounting surface of the lift plate with the top surface non-parallel to the topmost working surface;

a coupling arrangement comprising a sliding connection between the lift plate and the base configured to allow the lift plate to move vertically relative to the base;

a lifting mechanism comprising a threaded rod configured to rotate about a threaded axis, wherein the rotation of the threaded rod controls a vertical distance between the top surface and the topmost working surface of the base;

wherein in operation, the base is stationary, the abrading medium is secured to the top surface with the clamping arrangement, the lift plate is vertically positioned by rotation of the threaded rod to locate the abrading surface at a desired distance from the topmost working surface of the base, and the abrading medium mounting plate is adjusted with the adjustment arrangement to orient and secure the abrading surface parallel to the topmost working surface of the base.

8. The abrading medium lift system of claim 7, further comprising:

a leveling plate with a surface configured to rest on the topmost working surface of the base and a positioning surface configured to contact the abrading surface when the desired distance has been established, and to orient the abrading surface parallel to the topmost working surface.

9. The abrading medium lift system of claim 7, wherein the abrading medium comprises at least one of a grinding stone, honing stone, or whetstone or other abrading material.

10. The abrading medium lift system of claim 7, wherein the adjustment arrangement comprises:

a threaded fastener for securing the abrading medium mounting plate to the lift plate;

the mounting surface of the lift plate being concave spherically shaped;

the bottom surface of the abrading medium mounting plate being convex spherically shaped and sized to substantially match the mounting surface;

wherein the abrading medium mounting plate can be secured to the lift plate with the threaded fastener, the top surface non parallel to the topmost working surface.

11. The abrading medium lift system of claim 7, wherein the clamping arrangement comprises:

a plurality of blind holes in the top surface of the abrading medium mounting plate;

at least one removable pin, configured to be inserted into at least one of the plurality of blind holes;

a wedge shaped clamp jaw, configured to slide on the top surface, the wedge shaped clamp jaw comprising a first edge surface configured to slidingly abut the at least one removable pin and a second edge surface configured to slidingly abut the second side surface of the abrading medium;

wherein the wedge shaped clamp jaw is configured to be placed on the top surface and simultaneously abut the at least one removable pin and the second side surface of the abrading medium and is additionally slid to create a wedging force between the at least one removable pin and the second side surface of the abrading medium that clamps the abrasive medium against the stopping surface of the abrading medium mounting plate.

12. The abrading medium lift system of claim 7, wherein the clamping arrangement comprises:

at least one slot in the abrading medium mounting plate the at least one slot forming at least one extending bottommost slot surface parallel to the top surface;

a clamp jaw comprising a second edge surface, configured to abut the second side surface of the abrading medium, and configured to slide in the at least one slot and slide on the top surface;

a threaded clamp rod, attached to the clamp jaw and configured to rotate about a screw axis and thereby position the clamp jaw on the top surface;

wherein the threaded clamp rod is rotated to position the second edge surface to abut the second side surface of the abrasive medium and is additionally rotated to create a force between the clamp jaw and the second side surface of the abrading medium that clamps the abrasive medium against the stopping surface of the abrading medium mounting plate.

13. The abrading medium lift system of claim 7 wherein the clamping arrangement comprises:

at least one slot in the abrading medium mounting plate the at least one slot forming at least one extending bottommost slot surface parallel to the top surface;

a wedge clamp jaw, configured to secure on the top surface, the wedge clamp jaw comprising a first wedge surface;

a wedge plate comprising a second wedge surface and a second edge surface, the wedge plate configured to be placed on the top surface with the second wedge surface in abutment with the first wedge surface, and the second edge surface in abutment with the second side surface of the abrading medium;

wherein the wedge plate is configured to be placed on the top surface and simultaneously abut the first wedge surface of the wedge clamp jaw and the second side surface of the abrading medium and be additionally slid to create a wedging force between the wedge clamp jaw and the second side surface of the abrading medium that clamps the abrasive medium against the stopping surface of the abrading medium mounting plate.

14. The abrading medium lift system of claim 7, wherein the stopping surface of the abrading medium mounting plate is repositionable.

15. An abrading medium work platform system configured to secure an abrading medium comprising, an abrading surface, a first side surface, a second side surface and a bottom surface, relative to a topmost working surface to remove the effect of height variation, thickness variation, and parallelism variation, the system comprising:

a platform comprising the topmost working surface; and a plurality of slots in the platform, each slot forming an extending bottommost slot surface parallel to the topmost working surface;

a stationary jaw fixed to, and projecting upward from, the topmost working surface, the stationary jaw comprising a first edge surface configured to abut the first side surface of the abrading medium, a clamping arrangement slidingly connected to the platform, the clamping arrangement configured to abut the second side surface of the abrading medium, and configured to slide on the topmost working surface;

a leveling plate with at least one surface configured to rest on the topmost working surface and a positioning surface configured to contact the abrading surface when a desired vertical distance has been established;

wherein the clamping arrangement is configured to engage and clamp against the second side surface of the abrading medium, while the abrading medium is simultaneously positioned with the first side surface of the abrading medium abutting the first edge surface and the abrading surface abutting the positioning surface, to secure the abrading surface at the desired vertical distance above the topmost working surface and parallel to the topmost working surface.

16. The abrading medium work platform of claim 15, wherein the clamping arrangement comprises a clamp jaw comprising a second edge surface, configured to abut the second side surface of the abrading medium, and configured to slide in the at least one slot and slide on the top surface.

17. The abrading medium work platform of claim 15, wherein the clamp jaw is fixed to a clamp slot rod that engages inside surfaces of the at least one slot and the clamp jaw is configured to slide along a direction of the slot to engage and clamp the second edge surface against the second side surface of the abrading medium.

18. The abrading medium work platform of claim 15, wherein the platform comprises a through hole opening which provides access to the bottom surface of the abrading medium.

19. The abrading medium lift system of claim 15, wherein the abrading medium comprises at least one of a grinding stone, honing stone, whetstone or other abrading material.

20. A method of securing an abrading medium comprising, an abrading surface, a first side surface, a second side surface and a bottom surface, relative to a topmost working surface to remove the effect of height variation, thickness variation, and parallelism variation, the method including:

providing an abrading medium work platform system, the system comprising:

a platform comprising the topmost working surface; and a plurality of slots in the platform, each slot forming an extending bottommost slot surface parallel to the topmost working surface;

a stationary jaw fixed to, and projecting upward from, the topmost working surface, the stationary jaw comprising a first edge surface configured to abut the first side surface of the abrading medium, a clamping arrangement slidingly connected to the platform, the clamping arrangement configured to abut the second side surface of the abrading medium, and configured to slide on the topmost working surface;

a leveling plate with at least one surface configured to rest on the topmost working surface and a positioning surface configured to contact the abrading surface when a desired vertical distance has been established;

wherein the clamping arrangement is configured to engage and clamp against the second side surface of the abrading medium, while the abrading medium is simultaneously positioned with the first side surface of the abrading medium abutting the first edge surface and the abrading surface abutting the positioning surface, to secure the abrading surface at the desired vertical distance above the topmost working surface and parallel to the topmost working surface;

positioning the abrasive medium between the stationary jaw and the clamping arrangement and under the leveling plate;

lifting the abrasive medium to position the abrading surface in contact with the positioning surface of the leveling plate;

holding the abrading medium simultaneously positioned with the first side surface of the abrading medium abutting the first edge surface and the abrading surface abutting the positioning surface;

securing the clamping arrangement against the second side surface of the abrading medium with the abrading surface parallel to the topmost working surface and spaced at a desired distance from the topmost working surface.

21. A method of securing an abrading medium of claim 20, wherein the abrading medium comprises at least one of a grinding stone, honing stone, whetstone or other abrading material.

* * * * *